US006674421B2

(12) United States Patent
Mori et al.

(10) Patent No.: US 6,674,421 B2
(45) Date of Patent: Jan. 6, 2004

(54) DRIVE METHOD FOR LIQUID CRYSTAL DISPLAY DEVICE

(75) Inventors: Hideo Mori, Kanagawa-ken (JP); Takeshi Togano, Kanagawa-ken (JP); Seishi Miura, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 165 days.

(21) Appl. No.: 09/826,165

(22) Filed: Apr. 5, 2001

(65) Prior Publication Data

US 2001/0043180 A1 Nov. 22, 2001

(30) Foreign Application Priority Data

Apr. 6, 2000 (JP) ..... 2000-104519

(51) Int. Cl.[7] ..... G09G 3/36
(52) U.S. Cl. ..... 345/96; 345/95
(58) Field of Search ..... 345/90, 91, 92, 345/93, 98, 99, 100, 87, 208–210; 349/42

(56) References Cited

U.S. PATENT DOCUMENTS

| | | | | |
|---|---|---|---|---|
| 5,075,596 A | * | 12/1991 | Young et al. | 315/169.3 |
| 5,739,803 A | * | 4/1998 | Neugebauer | 345/98 |
| 5,815,230 A | | 9/1998 | Miura et al. | 349/129 |
| 5,847,799 A | | 12/1998 | Tanaka et al. | 349/174 |
| 6,115,018 A | * | 9/2000 | Okumura et al. | 345/95 |
| 6,195,147 B1 | | 2/2001 | Asao et al. | 349/133 |
| 6,329,980 B1 | * | 12/2001 | Uehara et al. | 345/204 |
| 2001/0048407 A1 | * | 12/2001 | Yasunishi et al. | 345/60 |

FOREIGN PATENT DOCUMENTS

| | | | |
|---|---|---|---|
| JP | 9-50049 | | 2/1997 |
| JP | 2681528 | | 11/1997 |
| JP | 2000-10076 | | 1/2000 |
| JP | 2000-338464 | | 12/2000 |
| JP | 020011188515 A | * | 7/2001 |

* cited by examiner

*Primary Examiner*—Vijay Shankar
*Assistant Examiner*—Nitin Patel
(74) *Attorney, Agent, or Firm*—Fitzpatrick, Cella, Harper & Scinto

(57) ABSTRACT

A driving method is described for a liquid crystal display device of the active matrix type which includes a pair of substrates and a liquid crystal disposed between the substrates so as to form a matrix of pixels provided with a plurality of pixel electrodes arranged in rows and columns, a plurality of row electrodes and a plurality of column electrodes, respectively, for applying a voltage to the pixels via the pixel electrodes, and a plurality of active elements each provided to a pixel and connected to a pixel electrode, a row electrode and a column electrode, respectively. The driving method includes a field-inversion drive scheme wherein the liquid crystal display device is driven while inverting a polarity of voltage applied to each pixel every picture scanning field. The voltage applied to each pixel is corrected based on a voltage to be applied to a column electrode connected to the pixel for a period from a time of selecting an active element at the pixel in a field period to a time of selecting the active element in a subsequent field period.

6 Claims, 9 Drawing Sheets

DRIVE METHOD FOR LIQUID CRYSTAL DISPLAY DEVICE

BACKGROUND OF THE INVENTION

The present invention relates to a driving method for a liquid crystal display device for use in a liquid crystal display apparatus, etc.

In recent years, liquid crystal display devices have been commercialized in various fields including monitors for personal computers, view finders for video camcorders and projectors. Most of these liquid crystal display devices employ twisted nematic (TN) liquid crystals.

However, the TN-type liquid crystal display devices have a problematic slower response speed and narrower viewing angle.

Incidentally, a color liquid crystal display device with no color filters driven according to a so-called field-sequential scheme has been proposed.

According to the field-sequential scheme, such a color filterless liquid crystal display device is used in combination with, e.g., three light sources of red (R), green (G) and blue (B), which are sequentially turned on to provide the color filterless liquid crystal display device with corresponding color images to be color-mixed in time sequence to form a desired color image. Accordingly, a liquid crystal used is required to possess such a response characteristic that its optical response is completed in each field period for a corresponding color in order to ensure the display of the desired color. As a result, the liquid crystal used for the field-sequential scheme is required to exhibit a higher response speed than ever.

In order to solve the above-mentioned problems, Yoshida et al have proposed a driving method using a combination of a mono-stabilized ferroelectric liquid crystal and a plurality of active (matrix) elements arranged in a matrix form (e.g., Japanese Patent No. 2681528). Such a mono-stabilized ferroelectric liquid crystal provides an electrical optical response characteristic such that the liquid crystal responds to the application of a voltage of one polarity to provide a V-T (voltage-transmittance) curve in a half-V character shape (i.e., a shape given by cutting V-character in half), as shown in FIG. 2 (referred to as a "half-V character-mode liquid crystal"). On the other hand, a TN liquid crystal having an electrical optical characteristic with respect to both a positive polarity voltage and a negative polarity voltage and a liquid crystal as proposed in Japanese Laid-Open Patent Application (JP-A) 9-50049 show an optical response (V-T characteristic) such that the liquid crystal substantially equally responds to both the positive polarity voltage and the negative polarity voltage to provide a V-T curve like a V character (referred to as a ("V character-mode liquid crystal").

FIG. 3 is a sequence (time chart) for driving a liquid crystal display device using a half-V character-mode liquid crystal by using active matrix elements, each adapted for a drive circuit unit as shown in FIG. 4.

Referring to FIG. 4, the drive circuit unit comprises a gate line drive circuit 41, a gate line (row electrode) 42, a source line (column electrode) 43, a source line drive circuit 44, a storage (retention) capacitor Ccs and a liquid crystal capacitor Clc.

According to the driving sequence (time chart) shown in FIG. 3, the entire picture area (panel plane) of the liquid crystal display device is scanned (for writing) six times (first to sixth scannings) in one frame period (e.g., 1/60 sec). Specifically, in each frame period, the first scanning (+(R) scanning) is effected for writing (supplying) a data voltage for a red (R) picture (image) of positive (+) polarity, and the second scanning (−(R) scanning) is effected for writing a data voltage for R picture of negative (−) polarity. Thereafter, the third scanning (+(G) scanning) is effected for writing a data voltage for a green (G) picture of (+) polarity, and the fourth scanning (−(G) scanning) is effected for writing a data voltage for G picture of (−) polarity. Further, the fifth scanning (+(B) scanning) is effected by writing a data voltage for a blue (B) picture of (+) polarity, and the sixth scanning (−(B) scanning) is effected for writing a data voltage of (−) polarity. On the other hand, a light source unit comprising three light sources of red (R), green (G) and blue (B) is turned on in such a manner that the R light source is turned on over the first and second scanning periods (for +(R) scanning and −(R) scanning), the G light source is turned on over the third and fourth scanning periods (for +(G) and −(G) scannings), and the B light source is turned on over the fifth and sixth scanning periods (for +(B) and −(B) scannings) sequentially in this order. These scannings are repeated in a succession of frame periods.

In the above sequence, the liquid crystal (half-V character-mode liquid crystal) provides an optical response (V-T characteristic) shown in FIG. 2, so that a color picture (image) display comprising R display state (based on the R data voltage), black state, G display state (based on the G data voltage), black state, B display state (based on the B data voltage), and black state in succession in each frame period is sequentially repeated, thus allowing full-color image display without using color filters.

However, the above-mentioned drive sequence (FIG. 3) is accompanied by problematic crosstalk, since the sequence is performed in a field-inversion drive scheme, wherein the polarity of the applied voltage to each pixel is inverted for each (one) picture scanning period ((+)→(−)→(+)→(−)→(+)→(−)).

More specifically, as shown in FIG. 5, pixel electrodes (defining the pixels) are accompanied by several parasitic (coupled) capacitances. Particularly, coupling the pixel electrode with the source line (data electrode) 43 causes an application of a voltage depending on a display picture (image) to the source line 43, so that a field-through phenomenon attributable to a fluctuation of voltage at the source line 43 occurs, thus leading to a potential fluctuation of the pixel electrodes. As a result, a transmittance (transmitted light quantity) of the liquid crystal display device is also changed, thus failing to obtain a desired gradational characteristic, i.e., the crosstalk phenomenon described below with reference to FIGS. 6 and 7.

FIG. 6 is a plan view for illustrating a mechanism of the crosstalk phenomenon, and FIG. 7 is a time chart for the quantitative explanation thereof.

Referring to FIG. 6, in this embodiment, a white display of a rectangular portion at pixel a and a rectangular portion at a region ranging from pixel b to pixel d is performed on a white background portion on the panel plane of the liquid crystal display device. A gate line I is disposed along the pixels a and b, and a gate line II is disposed along pixels c and d. On the other hand, a source line A is disposed along the pixels a and c, and a source line B is disposed along the pixels b and d. The gate lines I and II are successively scanned in this order.

For the scanning operation, referring to FIG. 7, the gate line I disposed along the pixels a and b is selected at times t3 and t3', and the gate line II disposed along the pixels c and d is selected at times t5 and t5'. On the other hand, a voltage applied to the source line A disposed along the pixels a and c is +Vw ((+) polarity voltage for writing white data) at a time t2, 0 V at a time t4, −Vw ((−) polarity voltage for writing white data having an absolute value identical to +Vw) at a time t2', and 0 V at a time t4'. Similarly, a voltage applied to the source line B disposed along the pixels b and d is +Vw ((−) polarity voltage for writing white data) at a time t1, 0 V at a time t6, −Vw ((−) polarity voltage for writing white at having an absolute value identical to +Vw) at a time t1', and 0 V at a time t6'.

Then, a change in pixel potential with time will be described with reference to FIG. 7 (and FIG. 6).

At the pixel a, the voltage +Vw of the source line A is applied when the gate line I is selected at time t3. Thereafter, an associated gate (of an active element such as thin film transistor (TFT)) is turned off, and a corresponding pixel potential is placed in a high impedance state for holding the voltage +Vw. At that time, however, the pixel potential at the pixel a is affected by field-through phenomenon attributable to a potential fluctuation of an associated line (with which the pixel electrode provides a parasitic capacitance), since there are parasitic capacitances coupled with the pixel electrode as shown in FIG. 5. The pixel potential at the pixel a is not changed until time t4 due to the potential +Vw of the source line A until time t4, but is somewhat dropped from time t4 because the source line A potential is changed to 0 V at time t4. Thereafter, the source line A potential is changed to −Vw at time t2', and the pixel potential at the pixel a is further dropped. Then, when the gate line I is selected at time t3', the source line A voltage −Vw is applied at the pixel a. Thereafter, the source line A potential is also changed at time t4' and at time t2 (in a subsequent (+) field), whereby the pixel potential at the pixel a is also affected at times t4' and t2. Each of the pixel potentials at the pixels b, c and d is similarly affected by a corresponding fluctuation in source line as shown in FIG. 7 (specific explanation therefor is omitted therein).

Next, the optical response at the pixels will be described.

Referring to FIG. 7, the voltage of +Vw is applied at the pixel a at time t3, whereby transmission state (at the pixel a) is changed to a white state. Thereafter, the resultant transmitted light quantity (transmittance) is changed with time under the influence of the fluctuation of the pixel potential as mentioned above. At the pixel a, the voltage of −Vw is applied at time t3', whereby the transmission state is changed to block state since the half-V character-mode liquid crystal used provides the V-T characteristic as shown in FIG. 2. Similarly, also at the pixel b, the voltages of +Vw and −Vw are applied at times t3 and t3', respectively. However, the fluctuation in pixel potential at the pixel b after the voltage applications (of +Vw and −Vw) is different from that at the pixel a, thus resulting in different (time-)integrated transmitted light quantities between the pixels a and b. As a result, a luminance difference is confirmed by the viewer. Further, at the pixel c shown in FIG. 6, an original (intended) display state is black, but an actually displayed picture is white (light source color) due to the crosstalk phenomenon attributable to the pixel potential fluctuation.

Such a crosstalk phenomenon is ordinarily suppressed by a line-inversion drive scheme or dot-inversion drive scheme wherein a polarity of a voltage applied to a source line is inverted for one horizontal scanning period.

In the present invention, however, the liquid crystal display device is driven according to the above-mentioned field-sequential drive method using the field-sequential drive scheme, thus requiring another means or method other than the line- or dot-inversion drive scheme for preventing the crosstalk phenomenon.

SUMMARY OF THE INVENTION

A principal object of the present invention is to provide a driving method for a liquid crystal display device having solved the above-mentioned problems.

A specific object of the present invention is to provide a driving method for a liquid crystal display device capable of suppressing the occurrence of crosstalk phenomenon, applicable to a field-sequential drive using a field-inversion scheme, regardless of inversion schemes.

According to the present invention, there is provided a driving method for a liquid crystal display device of the active matrix type comprising: a pair of substrates and a liquid crystal disposed between the substrates so as to form a matrix of pixels provided with a plurality of pixel electrodes arranged in rows and columns, a plurality of row electrodes and a plurality of column electrodes, respectively, for applying a voltage to the pixels via the pixel electrodes, and a plurality of active elements, each provided to a pixel and connected to a pixel electrode, a row electrode and a column electrode, respectively, the driving method comprising driving the liquid crystal display device while inverting a polarity of voltage applied to each pixel every picture scanning field, wherein the voltage applied to each pixel is corrected based on a voltage to be applied to a column electrode connected to the pixel for a period from a time of selecting an active element at the pixel in a field period to a time of selecting the active element in a subsequent field period.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

In the driving method for a liquid crystal display device according to the present invention, the above-described crosstalk phenomenon (occurring in the field-inversion drive scheme) is suppressed by calculating an amount of pixel potential fluctuation at a pixel from an amount of change in source voltage in a period where the pixel is placed in a high impedance state, i.e., from picture (image) data and voltage polarity data in the source line (vertical) direction located along the pixel and correcting picture (image) data so as to correct the calculated fluctuation amount of the pixel potential.

Hereinbelow, the driving method for a liquid crystal display device according to the present invention will be described based on preferred embodiments.

Figure 5:
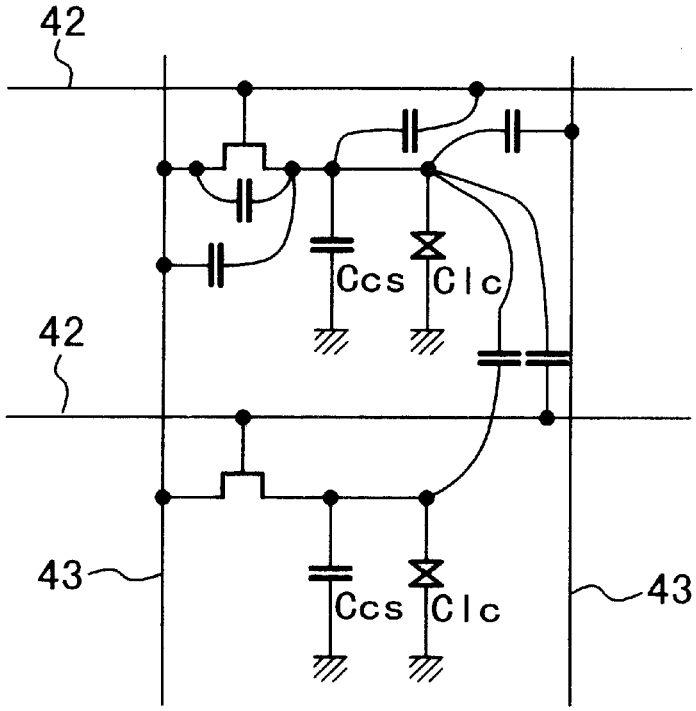
FIG. 5 is a circuit diagram of an embodiment of an active matrix liquid crystal for illustrating the presence of parasitic capacitances.
Figure 6:
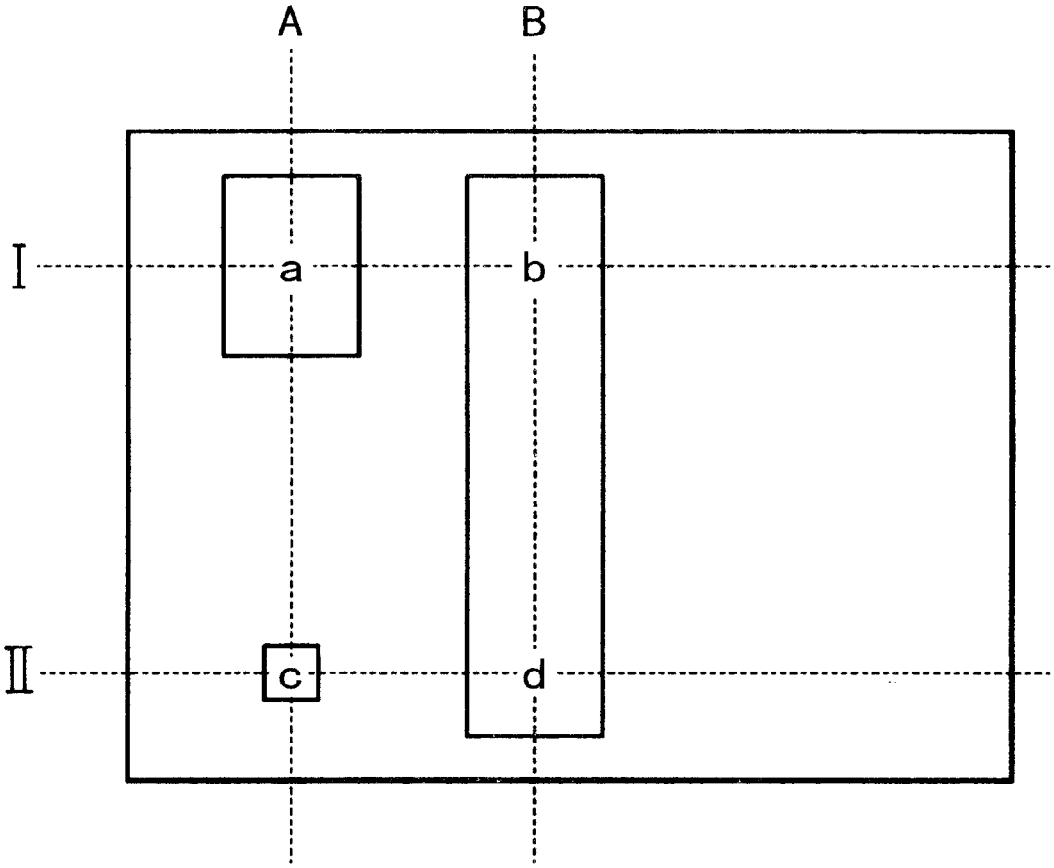
FIG. 6 is a schematic plan view showing a display state accompanied with a crosstalk portion.
Figure 7:
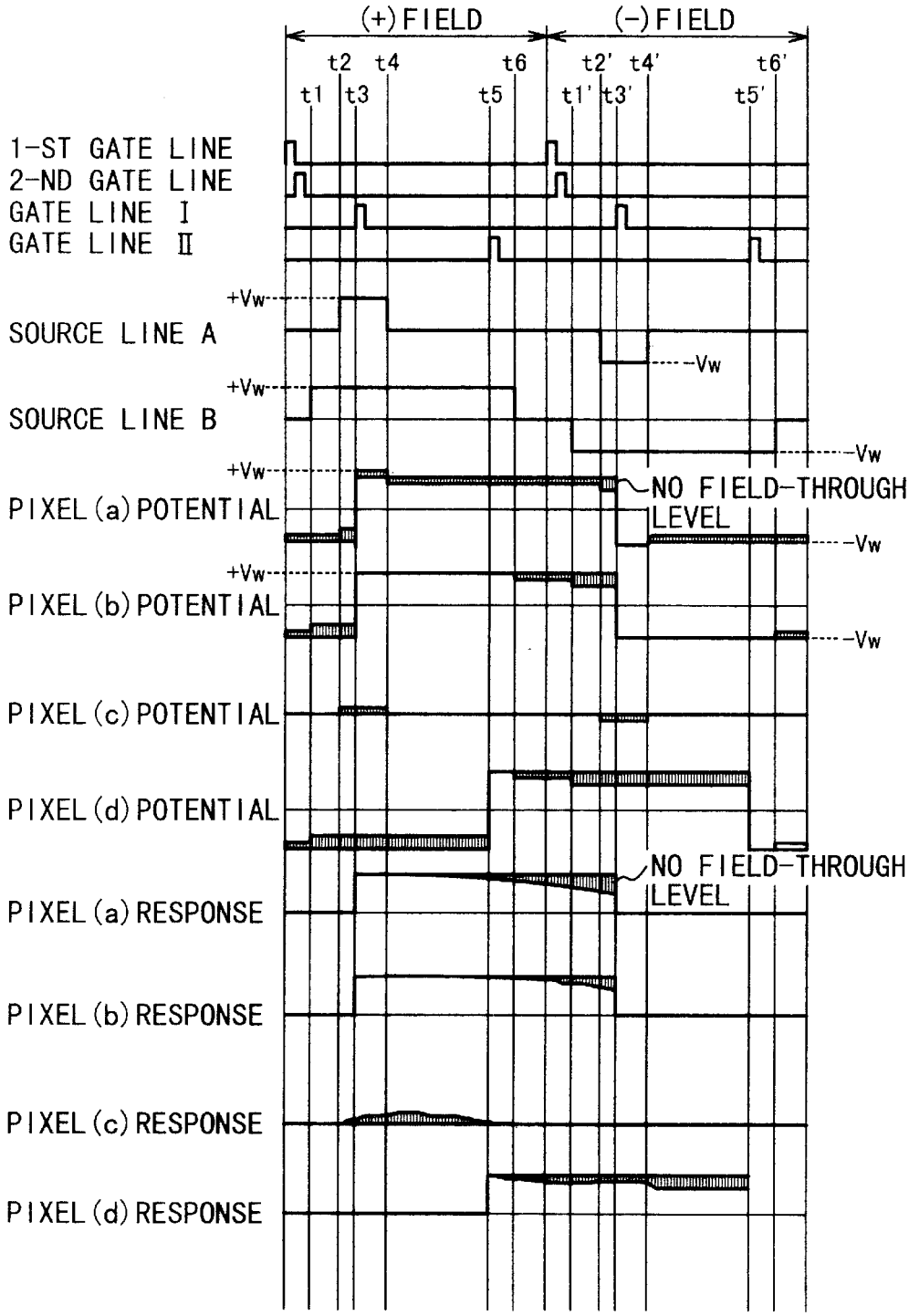
FIG. 7 is a time chart for the quantitative explanation of crosstalk phenomenon.

In a preferred embodiment of the present invention, a driving method for a liquid crystal display device of the active matrix type comprising a pair of substrates and a liquid crystal disposed between the substrates so as to form a matrix of pixels provided with a plurality of pixel electrodes arranged in rows and columns, a plurality of row electrodes and a plurality of column electrodes, respectively, for applying a voltage to the pixels via the pixel electrodes, and a plurality of active elements each provided to a pixel and connected to a pixel electrode, a row electrode and a column electrode, respectively, comprises driving the liquid crystal display device while inverting a polarity of voltage applied to each pixel every picture scanning field, wherein the voltage applied to each pixel is corrected based on a voltage value obtained by multiplying a difference in average voltage value between a voltage supplied to the pixel depending on a display picture and a voltage supplied to another pixel, depending on the display picture, provided with an active element connected to a column electrode to which the pixel is also connected, and a correction coefficient $\eta$ together. At that time, the correction coefficient $\eta$ may preferably be obtained from the following relational formula of capacitances:

$$\eta = Cds/(Cds+Cgd+Clc+Ccs)$$

wherein Cds represents a principal parasitic capacitance between the column electrode and an associated pixel electrode; Cgd represents a principal parasitic capacitance between the pixel electrode and an associated row electrode Clc represents, a liquid crystal capacitance at the pixel, and Ccs represents a storage capacitance at the pixel. In this regard, in order to more exactly calculate the correction coefficient $\eta$, the value of parasitic capacitances (Cds+Cgd) may preferably be replaced with a total value of all the parasitic capacitances (including Cds and Cgd) other than Clc and Ccs (as shown in FIG. 5).

In the present invention, the liquid crystal may preferably be a chiral smectic liquid crystal, particularly a chiral smectic liquid crystal which has a phase transition series of isotropic phase (Iso), cholesteric phase (Ch) and chiral smectic C phase (SmC*) or phase transition series of isotropic phase (Iso) and chiral smectic C phase (SmC*), respectively, on temperature decrease. Specific examples of such a chiral smectic liquid crystal includes those described in JP-A 2000-338464 and JP-A 2000-010076.

Further, the liquid crystal may preferably have an alignment characteristic such that the liquid crystal is aligned to provide an average molecular axis to be placed in a monostable alignment state under no voltage application, is tilted from the monostable alignment state in one direction when supplied with a voltage of a first polarity at a tilting angle which varies depending on the magnitude of the supplied voltage, and is tilted from the monostable alignment state in the other direction when supplied with a voltage of a second polarity opposite to the first polarity at a tilting angle, said tilting angles providing maximum tilting angles $\beta 1$ and $\beta 2$ formed under application of the voltages of the first and second polarities, respectively, satisfying $\beta 1 > \beta 2$. The maximum tilting angles $\beta 1$ and $\beta 2$ may preferably satisfy $\beta 1 \geqq 5 \times \beta 2$.

Particularly, the liquid crystal may preferably have an alignment characteristic such that the liquid crystal is aligned to provide an average molecular axis to be placed in a monostable alignment state under no voltage application, is tilted from the monostable alignment state in one direction when supplied with a voltage of a first polarity at a tilting angle which varies depending on the magnitude of the supplied voltage, but is not substantially tilted from the monostable alignment state in the other direction when supplied with a voltage of a second polarity opposite to the first polarity (i.e., $\beta 2 \approx 0$).

Further, the chiral smectic liquid crystal may preferably have a helical pitch in its bulk state larger than a value two times a cell thickness.

Hereinbelow, the driving method for a liquid crystal display device of the present invention will be described more specifically based on specific embodiments with reference to the drawings.

First Embodiment

A driving method for a liquid crystal display device according to this embodiment will be explained with reference to FIGS. 1–3 and 8–11.

Figure 1:
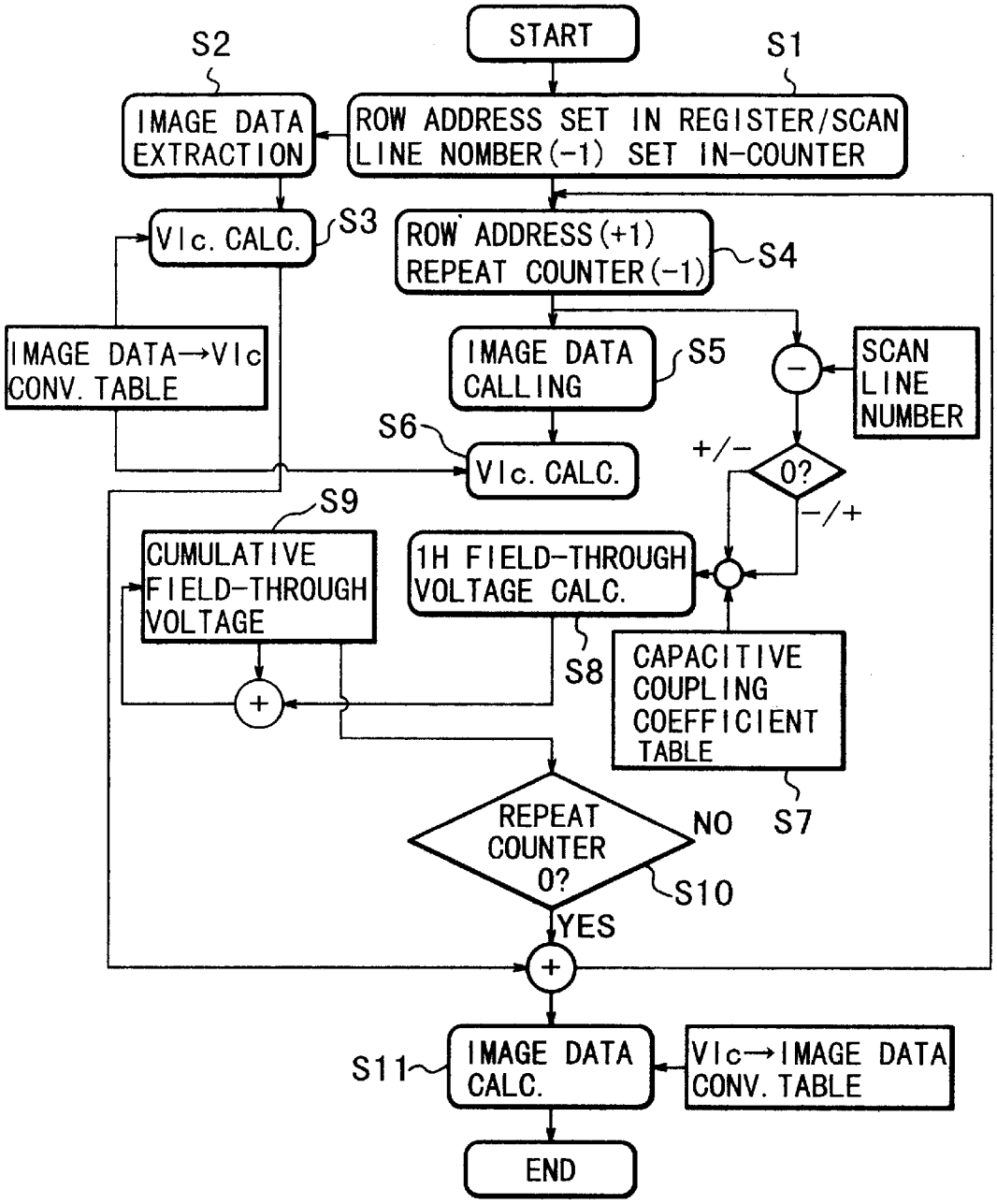
FIG. 1 is a flow chart showing the progress of the data processing system used in the First Embodiment according to the driving method for a liquid crystal display device of the present invention.
Figure 8:
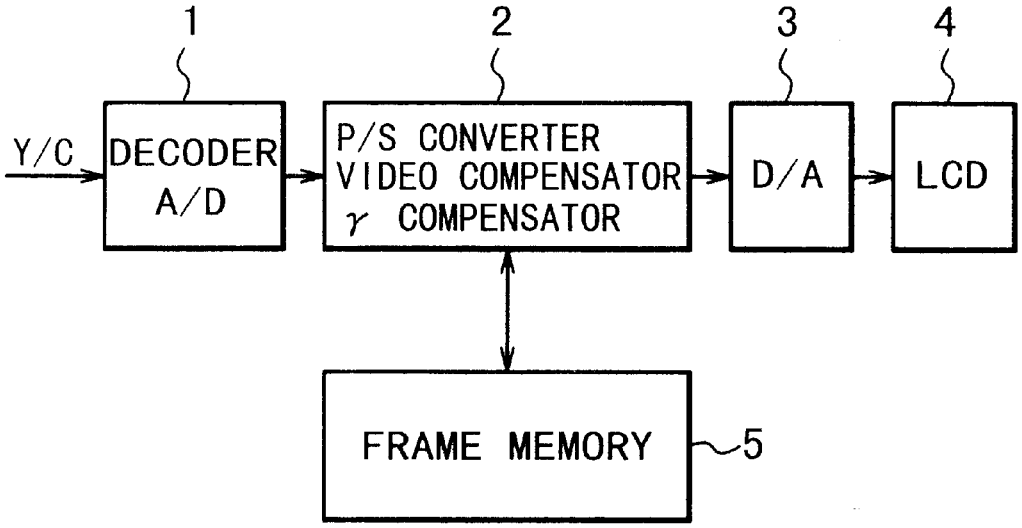
FIG. 8 is a block diagram showing a circuit structure adopted in the First Embodiment.
Figure 9:
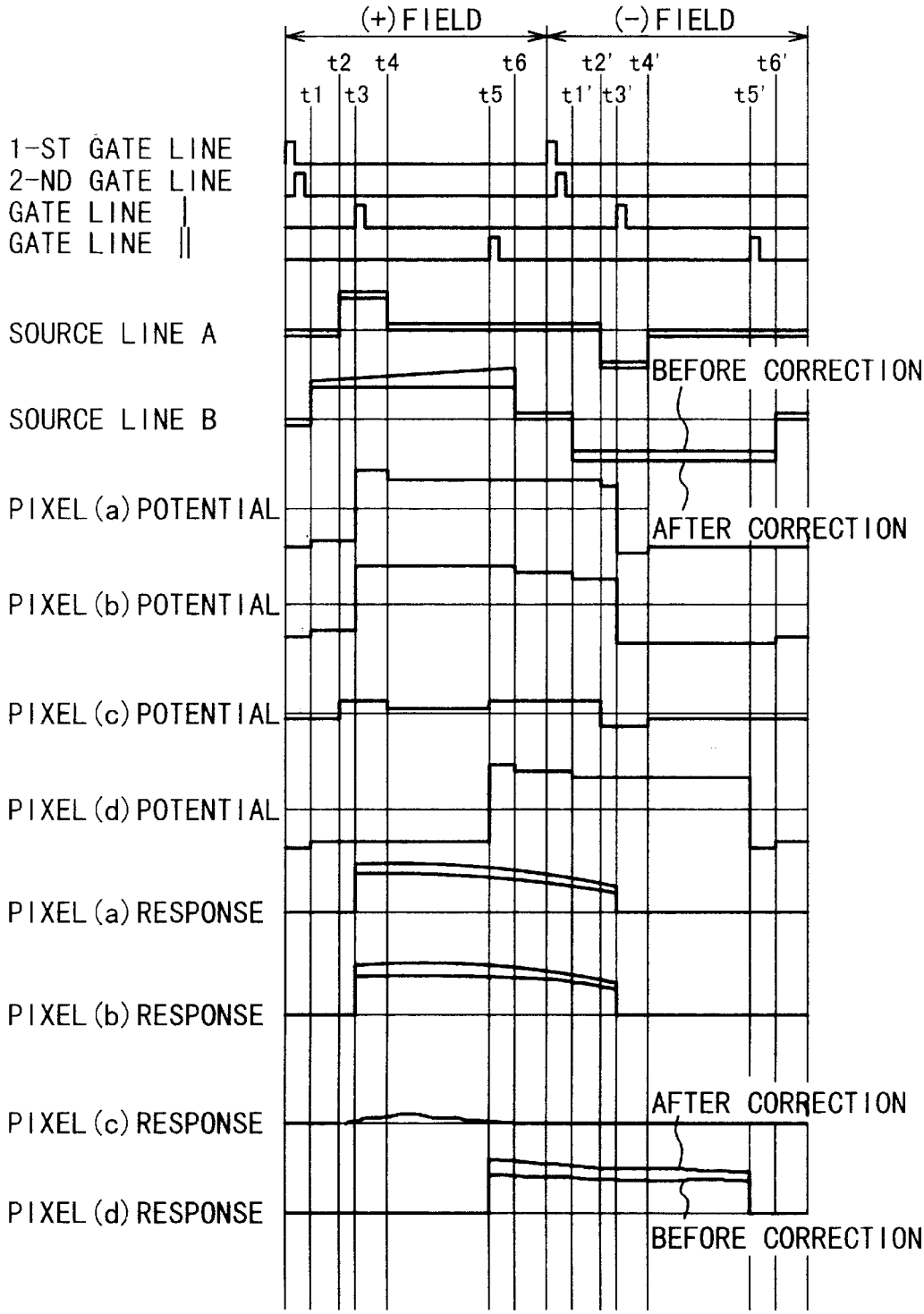
FIG. 9 is a time chart illustrating the effect of the First Embodiment.

FIG. 1 shows a flow chart of data processing, FIG. 8 is a block diagram showing a circuit structure, and FIG. 9 is a time chart illustrating an effect of this embodiment, respectively, described specifically hereinafter.

Figure 2:
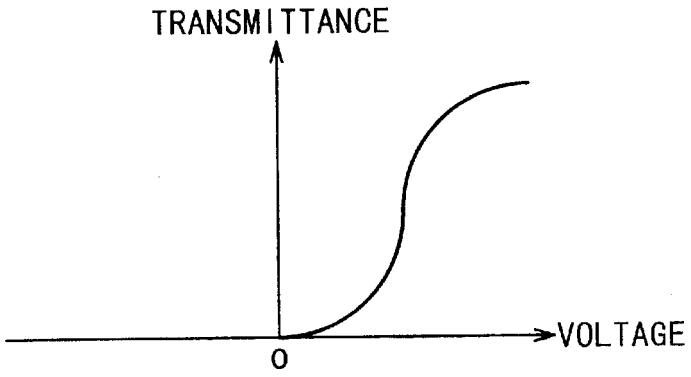
FIG. 2 is a graph showing a V-T (voltage-transmittance) characteristic of a liquid crystal device using half-V character-mode liquid crystal.
Figure 3:
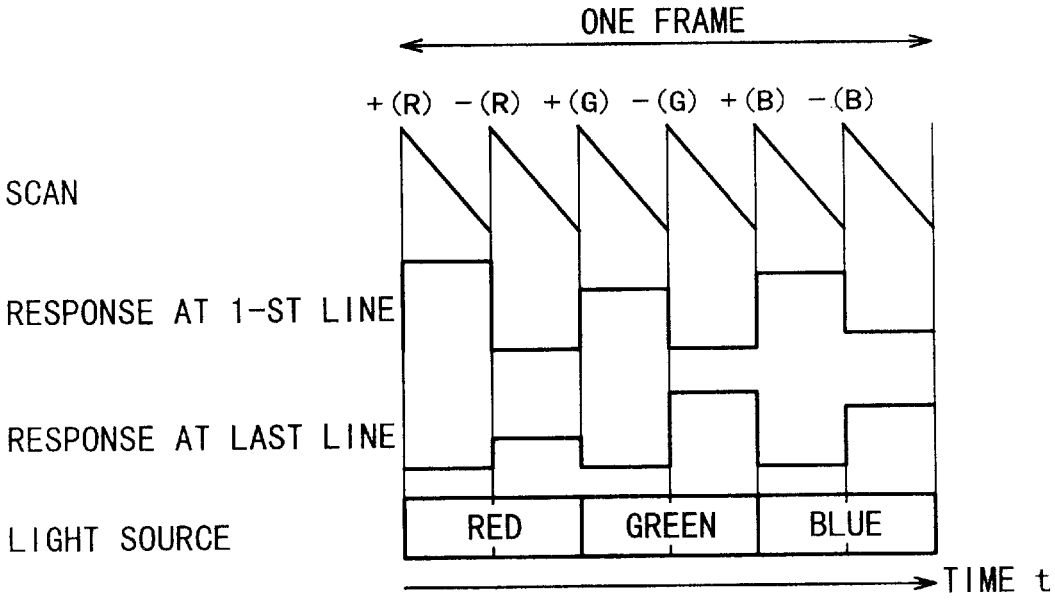
FIG. 3 is a time chart showing a sequence of a field-sequential drive scheme using the half-V character-mode liquid crystal.
Figure 4:
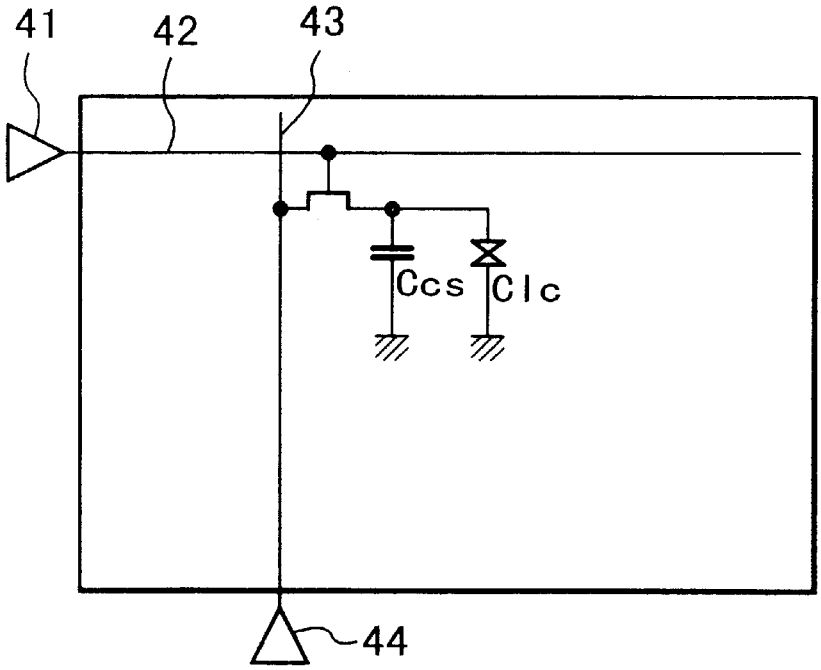
FIG. 4 is a circuit diagram of an embodiment of an active matrix liquid crystal display device.

The liquid crystal display device used in this embodiment is driven by a field-sequential drive scheme as shown in FIG. 3 and employs a half-V character-mode liquid crystal providing an electrooptical response characteristic (V-T characteristic) as shown in FIG. 2. Further, a memory space map used for the field-sequential drive scheme is shown in FIG. 10.

The system including the liquid crystal display device is used as a monitor for a digital video camcorder (DVC), a digital still camera (DSC), etc., and has a circuit structure shown in FIG. 8.

Figure 10:
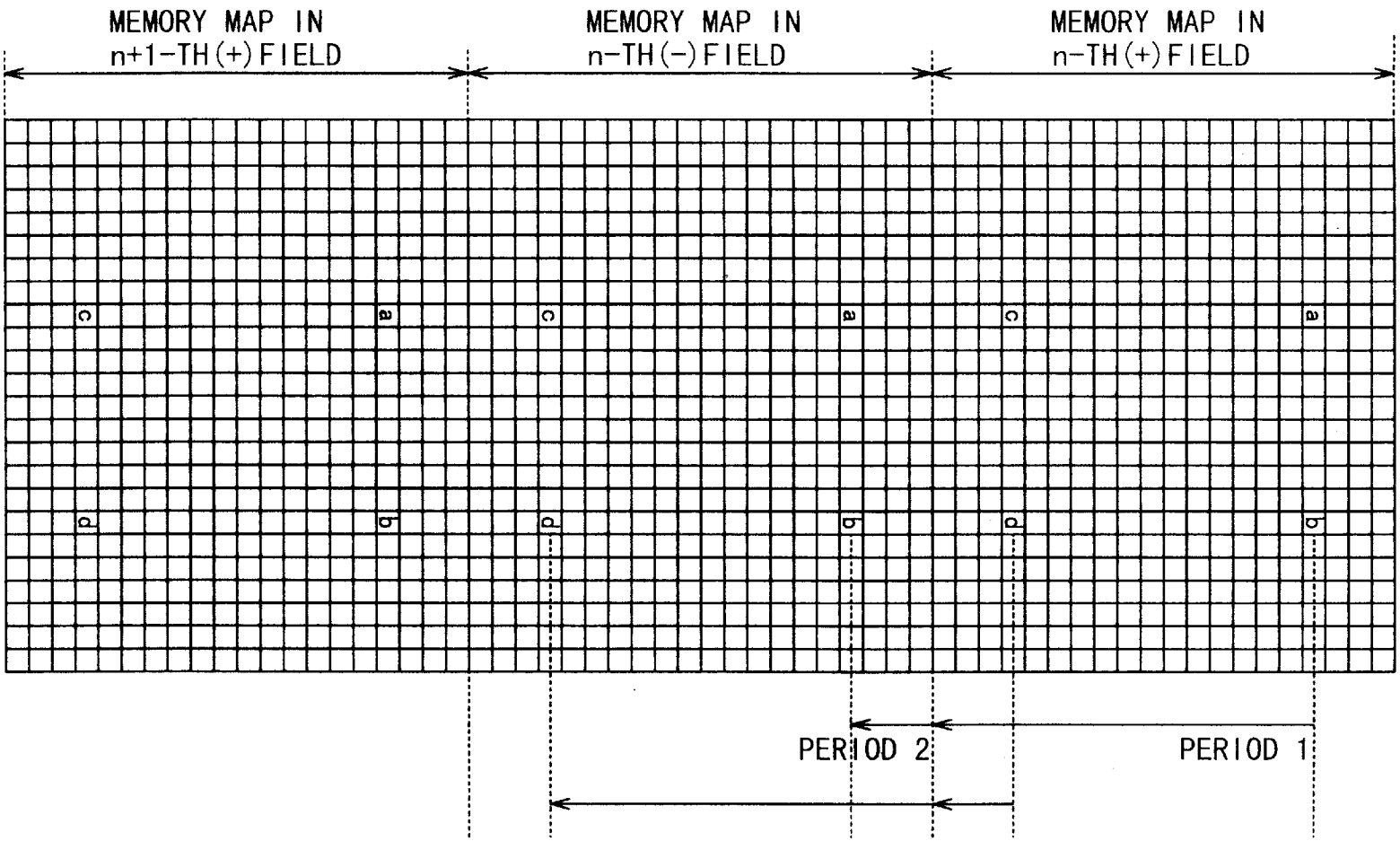
FIG. 10 is a schematic view showing a memory space map used in the First Embodiment.

Referring to FIG. 8, the system includes a circuit block 1 for converting video signals (Y/C) into digital picture (image) data; a circuit block 2 for converting parallel picture data of red (R), green (G) and blue (B) (outputted from the circuit block 1) into serial picture data of R, G and B, respectively and for correcting the picture data based on a characteristic of a LCD (liquid crystal display device) 4; a circuit block 3 for effecting D/A (digital-to-analog) conversion of the corrected picture data into analog picture signals meeting the LCD characteristic; the LCD 4 supplied with the analog picture signals; and a frame memory 5 having a memory space shown in FIG. 10.

Herein, explanation for video decoding processing, P/S (parallel-to-serial) conversion processing and D/A (digital-to-analog) conversion processing will be omitted, and only the picture data correction processing performed in the circuit block 2 will be described.

The flow chart shown in FIG. 1 shows the picture data correction processing for suppressing crosstalk phenomenon resulting from a fluctuation in pixel potential due to a field-through phenomenon affected by a voltage fluctuation of a source line occurring at the time of the field-inversion drive scheme.

Referring to FIG. 1, the picture data correction processing principally includes 11 steps (steps 1–11).

More specifically, a row address is extracted from address data in a memory wherein picture data for a pixel (e.g., pixel a) to be processed are stored, and the extracted row address of the picture data (for pixel a) is set in a row address register while setting a value of "(the scanning line number)−1" in a repetition counter (Step 1).

On the other hand, an applied voltage Vlc (a source voltage to be applied to the pixel a) is calculated based on a picture data-to −Vlc (applied voltage) conversion table (showing a relationship between the picture data (for the pixel a) to be processed and an applied voltage corresponding to the picture data) (Steps 2 and 3). Incidentally, the applied voltage Vlc comprises digital data for providing the applied voltage, not an analog voltage actually applied to the pixel a.

Then, a value "1" is added to the value of the row address register and, at the time, a value "1" is subtracted from the value of the repetition counter (Step 4).

Based on the resultant value, picture data are read out (Step 5).

The picture data correspond to those for another pixel (substantially scanned on the next scanning line) located immediately below and the same longitudinal position as the pixel a. With respect to the picture data, an applied voltage Vlc is calculated based on the picture data-to −Vlc conversion table (Step 6).

On the other hand, based on a relationship between the scanning line number and row address value, the row address indicated by the address register value is judged whether the row address is in a period 1 for applying a positive (+) polarity voltage or in a period 2 for applying a negative (−) polarity voltage (Step 7).

Based on the judgement result and a capacitive coupling coefficient table indicating a degree of field-through phenomenon, an amount of a field-through voltage occurring at the pixel a by a voltage applied to a source line at the row address is calculated (Step 8).

The amount of the field-through voltage is stored in a prescribed memory space as a cumulative field-through voltage value Vf (Step 9). A field-through voltage value Vf in a period (one horizontal scanning period) is represented by the following equation:

$$Vf=\Delta Vs\times Cds/(Cds+Cgd+Clc+Ccs),$$

wherein ΔVs represents a change in voltage applied to the source line (43 shown in FIG. 5), Cds represents a parasitic capacitance between the source line and the pixel electrode, Cgd represents a parasitic capacitance between a gate line and the pixel electrode, Clc represents a liquid crystal capacitance at the pixel (pixel a), and Ccs represents a storage capacitance at the pixel (pixel a).

Then, the value of the repetition counter is confirmed (Step 10).

At that time, if the value is not 0, the process is returned to the addition of "1" to the row address counter (Step 4). If the value is 0, a voltage to be applied to the pixel a is calculated by adding the cumulative field-through voltage value Vf to the first calculated applied voltage Vlc. Finally, based on a Vlc (applied voltage)-to-picture data conversion table, a value of corrected picture data is obtained (Step 11). At that time, in the case where 6 bit-picture data (before correction) are used, the corrected picture data obtained through the above-mentioned picture data processing comprise larger bit-picture data than the 6-bit-picture data.

Figure 11:
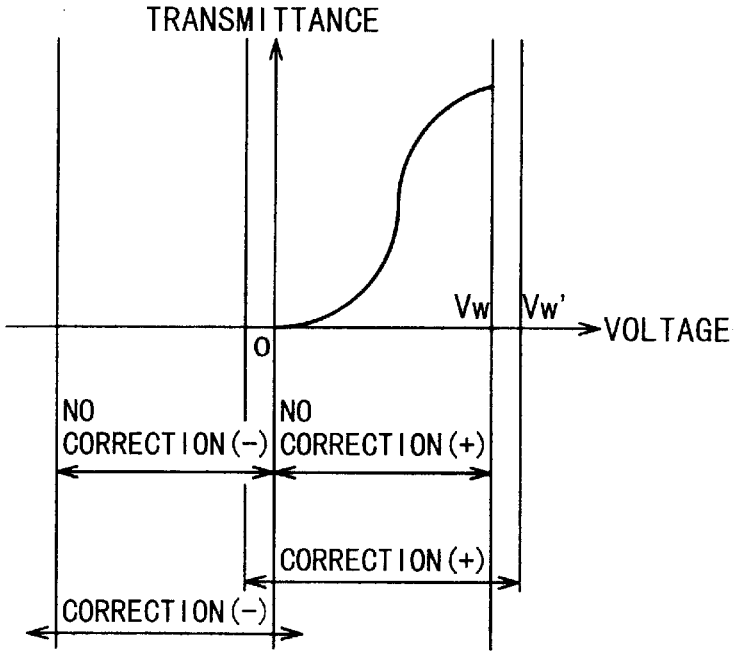
FIG. 11 is a graph showing ranges of voltage application to the half-V character mode-liquid crystal used in the First Embodiment.

Further, as shown in FIG. 11, if the field-through phenomenon is not taken into consideration, the voltage to be applied to the pixel is +Vw at the maximum. In the present invention, in view of the field-through phenomenon, the applied voltage to the pixel is corrected to provide a larger value +Vw', than +Vw. The voltage value +Vw' shows a maximum Vw'(max) represented by the following equation:

$$Vw'(\max)=Vw+2Vw\times Cds(Clc+Ccs+Cds+Cgd).$$

According to this embodiment, by applying to an associated source line a voltage corrected based on display picture (image) data so as to suppress a fluctuation in luminance due to the field-through phenomenon resulting from the source line voltage fluctuation, it is possible to provide a desired optical response (transmittance change) as shown in FIG. 9, thus allowing an accurate gradational display while considerably suppressing the occurrence of crosstalk phenomenon.

Second Embodiment

Figure 12:
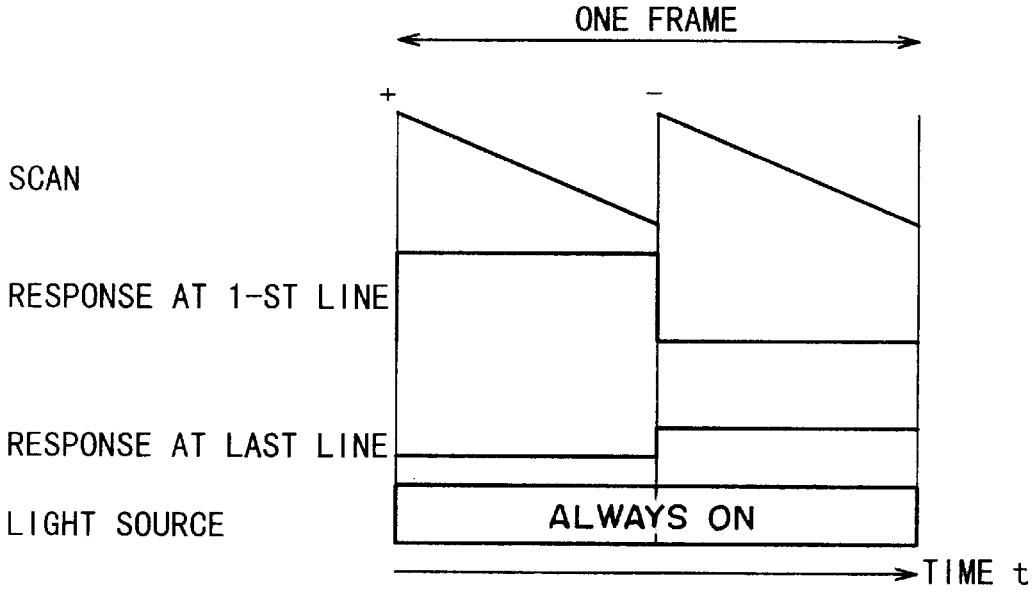
FIG. 12 is a time chart illustrating a drive sequence used in the Second Embodiment according to the driving method for a liquid crystal display device of the present invention.

In this embodiment, a liquid crystal display device provided with color filters is driven by a driving method according to a drive sequence shown in FIG. 12 (not the field-sequential drive scheme as in the First Embodiment) while effecting display picture data correction similarly to the First Embodiment.

Referring to FIG. 12, the color liquid crystal display device is driven by a two-fold speed (120 Hz) drive scheme wherein an input picture (image) at a frame rate (frequency) of 60 Hz is processed in (+) field and (−) field by using a frame memory therefor so as to utilize the V-T characteristic of the half-V character-mode liquid crystal used. Accordingly, in this embodiment, it is not necessary to use an additional frame memory.

According to this embodiment, the driving method according to the present invention is also effective for driving the liquid crystal display device using the color filters while suppressing the occurrence of crosstalk phenomenon.

As described hereinabove, according to the driving method for a liquid crystal display device of the present invention, it is possible to effectively suppress crosstalk phenomenon (occurring in the field-inversion dive scheme) by calculating an amount of pixel potential fluctuation at a pixel from an amount of change in source voltage in a period where the pixel is placed in a high impedance state, i.e., from picture (image) data and voltage polarity data in the source line (vertical) direction located along the pixel and correcting picture (image) data so as to correct the calculated fluctuation amount of the pixel potential. As a result, a desired gradational display with accuracy is realized.

What is claimed is:

1. A driving method for a liquid crystal display device of the active matrix type, said liquid crystal display device comprising:

a pair of substrates and a liquid crystal disposed between the substrates so as to form a matrix of pixels provided with a plurality of pixel electrodes arranged in rows and columns;

a plurality of row electrodes and a plurality of column electrodes, respectively, for applying a voltage to the pixels via the pixel electrodes; and a plurality of active elements each provided to a pixel and connected to a pixel electrode, a row electrode and a column electrode, respectively;

the driving method comprising driving the liquid crystal display device while inverting a polarity of voltage applied to each pixel every picture scanning field;

wherein a picture data of each pixel is corrected based on a voltage to be applied to a column electrode connected to the pixel for a period from a time of selecting an active element at the pixel in a field period to a time of selecting the active element in a subsequent field period; and wherein the picture data of each pixel is corrected based on a voltage value obtained by multiplying a difference in average voltage value between a voltage supplied to the pixel depending on a display picture and a voltage supplied to another pixel, depending on the display picture, provided with an active element connected to a column electrode to which the pixel is also connected, and a correction coefficient $\eta$ together.

2. The method according to claim 1, wherein the correction coefficient $\eta$ is obtained from a relational formula of capacitances including a parasitic capacitance Cds between the column electrode and an associated pixel electrode, a parasitic capacitance Cgd between the pixel electrode and an associated row electrode, a liquid crystal capacitance Clc at the pixel, and a storage capacitance Ccs at the pixel.

3. The method according to claim 2, wherein the correction coefficient $\eta$ is obtained from the following relational formula:

$$\eta = Cds/(Cds+Cgd+Clc+Ccs).$$

4. A driving method for a liquid crystal display device of the active matrix type, said liquid crystal display device comprising:

a pair of substrates and a liquid crystal disposed between the substrates so as to form a matrix of pixels provided with a plurality of pixel electrodes arranged in rows and columns;

a plurality of row electrodes and a plurality of column electrodes respectively, for applying a voltage to the pixels via the pixel electrodes; and a plurality of active elements each provided to a pixel and connected to a pixel electrode, a row electrode and a column electrode, respectively;

the driving method comprising driving the liquid crystal display device while inverting a polarity of voltage applied to each pixel every picture scanning field;

wherein a picture data of each pixel is corrected based on a voltage to be applied to a column electrode connected to the pixel for a period from a time of selecting an active element at the pixel in a field period to a time of selecting the active element in a subsequent field period; and wherein the liquid crystal has an alignment characteristic such that the liquid crystal is aligned to provide an average molecular axis to be placed in a monostable alignment state under no voltage application, is tilted from the monostable alignment state in one direction when supplied with a voltage of a first polarity at a tilting angle which varies depending on magnitude of the supplied voltage, and is tilted from the monostable alignment state in the other direction when supplied with a voltage of a second polarity opposite to the first polarity at a tilting angle, said tilting angles providing maximum tilting angles $\beta 1$ and $\beta 2$ formed under application of the voltages of the first and second polarities, respectively, satisfying $\beta 1 > \beta 2$.

5. The method according to claim 4, wherein the maximum tilting angles $\beta 1$ and $\beta 2$ satisfy $\beta 1 \geqq 5 \times \beta 2$.

6. A driving method for a liquid crystal display device of the active matrix type, said liquid crystal display device comprising:

a pair of substrates and a liquid crystal disposed between the substrates so as to form a matrix of pixels provided with a plurality of pixel electrodes arranged in rows and columns;

a plurality of row electrodes and a plurality of column electrodes, respectively, for applying a voltage to the pixels via the pixel electrodes; and a plurality of active elements each provided to a pixel and connected to a pixel electrode, a row electrode and a column electrode, respectively;

the driving method comprising driving the liquid crystal display device while inverting a polarity of voltage applied to each pixel every picture scanning field;

wherein a picture data of each pixel is corrected based on a voltage to be applied to a column electrode connected to the pixel for a period from a time of selecting an active element at the pixel in a field period to a time of selecting the active element in a subsequent field period; and wherein the liquid crystal has an alignment characteristic such that the liquid crystal is aligned to provide an average molecular axis to be placed in a monostable alignment state under no voltage application, is tilted from the monostable alignment state in one direction when supplied with a voltage of a first polarity at a tilting angle which varies depending on magnitude of the supplied voltage, but is not substantially tilted from the monostable alignment state in the other direction when supplied with a voltage of a second polarity opposite to the first polarity.

* * * * *

UNITED STATES PATENT AND TRADEMARK OFFICE

CERTIFICATE OF CORRECTION

PATENT NO. : 6,674,421 B2
DATED : January 6, 2004
INVENTOR(S) : Mori et al

It is certified that error appears in the above-identified patent and that said Letters Patent is hereby corrected as shown below:

Title page,
Item [75], Inventors:
Reads "Hideo Mori, Kanagawa-ken (JP);
Takeshi Togano, Kanagawa-ken (JP);
Seishi Miura, Kanagawa-ken (JP);
Should read -- Hideo Mori, Yokohama (JP);
Takeshi Togano, Chigasaki (JP);
Seishi Miura, Sagamihara (JP) --.
Item [56], References Cited, FOREIGN PATENT DOCUMENTS, "020011188515" should read -- 2001-1188515 --.

Signed and Sealed this

Thirteenth Day of July, 2004

JON W. DUDAS
*Acting Director of the United States Patent and Trademark Office*